United States Patent [19]

Poll

[11] Patent Number: 4,523,529

[45] Date of Patent: Jun. 18, 1985

[54] PROCESS AND BURNER FOR THE PARTIAL COMBUSTION OF SOLID FUEL

[75] Inventor: Ian Poll, Amsterdam, Netherlands

[73] Assignee: Shell Oil Company, Houston, Tex.

[21] Appl. No.: 539,457

[22] Filed: Oct. 6, 1983

[30] Foreign Application Priority Data

Oct. 19, 1982 [GB] United Kingdom ..... 8229811

[51] Int. Cl.[3] ..... F23D 1/00

[52] U.S. Cl. ..... 110/263; 110/261; 110/264; 110/265; 110/347

[58] Field of Search ..... 110/347, 260, 261, 262, 110/263, 264, 265

[56] References Cited

U.S. PATENT DOCUMENTS 2,616,252 11/1952 Robinson et al. ..... 110/347
4,060,397 11/1977 Buiter et al. ..... 48/197 R
4,270,895 6/1981 Vatsky ..... 110/264
4,350,103 9/1982 Poll ..... 110/347
4,353,712 10/1982 Marion et al. ..... 48/197 R

FOREIGN PATENT DOCUMENTS 0021461 7/1981 European Pat. Off. .
184817 11/1982 Japan ..... 110/260

*Primary Examiner*—Edward G. Favors
*Assistant Examiner*—Steven E. Warner

[57] ABSTRACT

A process and burner for the partial combustion of a finely divided solid fuel, wherein coal and oxygen is supplied to a reactor space via a central coal passage and a plurality of inwardly inclined oxygen outlet passages supply oxygen. Each oxygen jet is surrounded by a shield of a moderate gas from an annular passage, preventing premature contact of free oxygen with reactor gas and the premature escape of solid fuel, broken-up by the oxygen jet from the break-up zone.

5 Claims, 2 Drawing Figures

PROCESS AND BURNER FOR THE PARTIAL COMBUSTION OF SOLID FUEL

BACKGROUND OF THE INVENTION

The invention relates to a process for the partial combustion of finely divided solid fuel and a burner for use in such a process.

Partial combustion—also referred to as gasification—of solid fuel can be achieved by reaction of the solid fuel with oxygen. The fuel contains as useful components mainly carbon and hydrogen, which react with the oxygen—and possibly with steam and carbon dioxide—to form carbon monoxide and hydrogen. Depending on the temperature, the formation of methane is also possible. While the invention is described primarily with reference to pulverized coal the process and burner according to the invention are also suitable for other finely divided solid fuels which can be partially combusted, such as for example lignite, pulverized wood, bitumen, soot and petroleum coke. In the gasificiation process pure oxygen or an oxygen containing gas, such as air or a mixture of air and oxygen, can be used. All of the above are referred to as oxygen.

In a well known process for partial combustion of solid fuel, finely divided solid fuel is passed into a reactor at a relatively high velocity. In the reactor a flame is maintained in which the fuel reacts with oxygen at temperatures above 1OOO° C. Since the residence time of the fuel in the reactor is relatively short, the risk of sintering of the solid fuel, which might cause plugging, is minimized. This aspect makes the above process suitable for the gasification of a wide range of solid fuels, even solid fuels having a tendency to sinter. The solid fuel is normally passed in a carrier gas to the reactor via a burner, while oxygen is simultaneously introduced into the reactor via said burner. Since solid fuel, even when it is finely divided, is usually less reactive than atomized liquid fuel or gaseous fuel, great care must be taken in the manner in which the fuel is dispersed in and mixed with the oxygen. If the mixing is insufficient, zones of underheating are generated in the reactor, next to zones of overheating, caused by the fact that part of the solid fuel does not receive sufficient oxygen and another part of the fuel receives too much oxygen. In zones of underheating the fuel is not completely gasified, while in zones of overheating the fuel is completely converted into less valuable products, i.e. carbon dioxide and water vapor. Local high temperatures in the reactor have a further drawback in that these will easily cause damage to the refractory lining which is normally arranged at the inner surface of the reactor wall.

In order to ensure a good mixing of fuel and oxygen it has already been proposed to mix the fuel and oxygen in or upstream of the burner prior to introducing the fuel into the reactor space. This implies, however, a disadvantage in that—especially at high pressure gasification—the design and operation of the burner is highly critical. The reason therefore is that the time elapsing between the moment of mixing and the moment the mixture enters the reactor must be invariably shorter than the combustion induction time of the mixture. The combustion induction time, however, considerably decreases with a rise in gasification pressure. When supplying a small quantity of fuel together with a small quantity of oxygen or oxygen-containing gas, the total velocity of the mixture in the burner will be low, so that the combustion induction time may be easily reached in the burner itself, with the risk of severe damage to the burner construction. The above problem of the risk of premature combustion in the burner could be avoided by mixing the fuel and oxygen outside the burner in the reactor space. In this case special provisions should be taken to ensure a good mixing of fuel and oxygen, necessary for a proper gasification. A drawback of mixing fuel and oxygen in the reactor outside the burner is, however, the risk of overheating of the burnerfront, due to a hot flame front caused by premature contact of free oxygen with already formed carbon monoxide and hydrogen in the reactor.

BRIEF DESCRIPTION OF THE INVENTION

The object of the invention is to remove the above drawbacks attending the various mixing possibilities and to provide a process for the partial combustion of solid fuel in which the fuel and oxygen or oxygen-containing gas are intensively mixed in the reactor outside the burner without the risk of overheating of the burner front.

The invention relates to a process for the partial combustion of a finely divided solid fuel which comprises introducing a core of the finely divided solid fuel and separately a plurality of jets of oxygen into a reactor space through a burner and allowing the oxygen to react with the solid fuel. The jets of oxygen are each directed towards the core of the finely divided solid fuel, are substantially uniformly distributed around said core and are each surrounded by a shield of a moderator gas.

The jets of oxygen cause a breakup of the core of solid fuel, so that a uniform mixing of the solid fuel and oxygen, necessary for an effective gasification process can be obtained. The shield of moderator gas, surrounding each of the oxygen jets prevents premature mixing of oxygen with the hot mixture of carbon monoxide and hydrogen present in the reactor and the premature escape of solid fuel, broken up by the action of the oxygen-containing jets, from the breakup zone. In this manner, the formation of a hot flame near the burner front, as well as the formation of less valuable products due to oxidation of carbon monoxide and hydrogen is obviated.

The burner for the partial combustion of a finely divided solid fuel according to the invention comprises a central passage for a finely divided solid fuel, a plurality of outlet passages for oxygen being inwardly inclined with respect to the central passage. The outlet passages are substantially uniformly distributed around the central passage, and each being surrounded by a substantially annular passage, for a moderator gas. A first conduit means supplies oxygen to the outlet passages, and the second conduit means supplies the moderator gas to the annular passages.

BRIEF DESCRIPTION OF THE DRAWINGS

The invention will now be further explained in more detail with reference to the attached drawings, in which.

PREFERED EMBODIMENT

Figure 1:
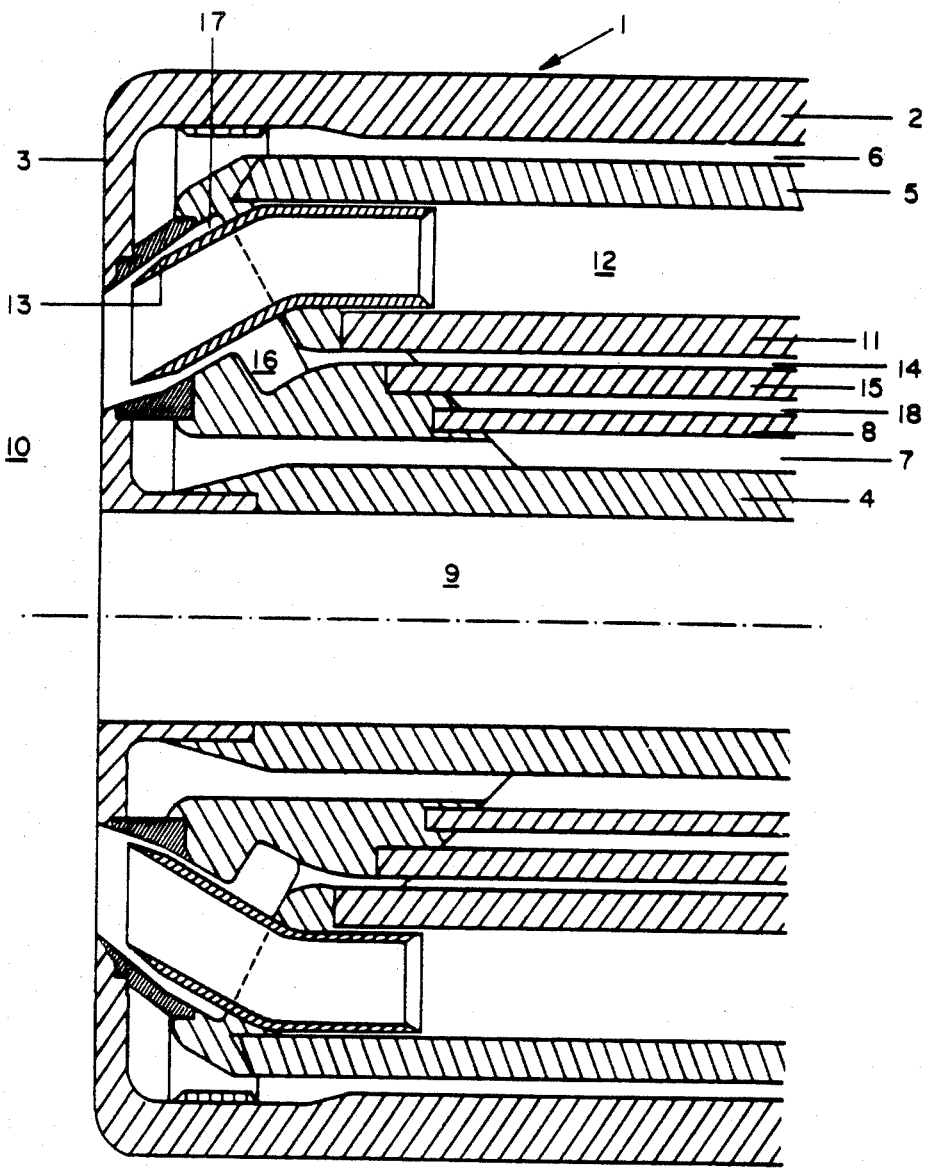
FIG. 1 shows schematically a longitudinal section of the front part of a burner according to the invention.
Figure 2:
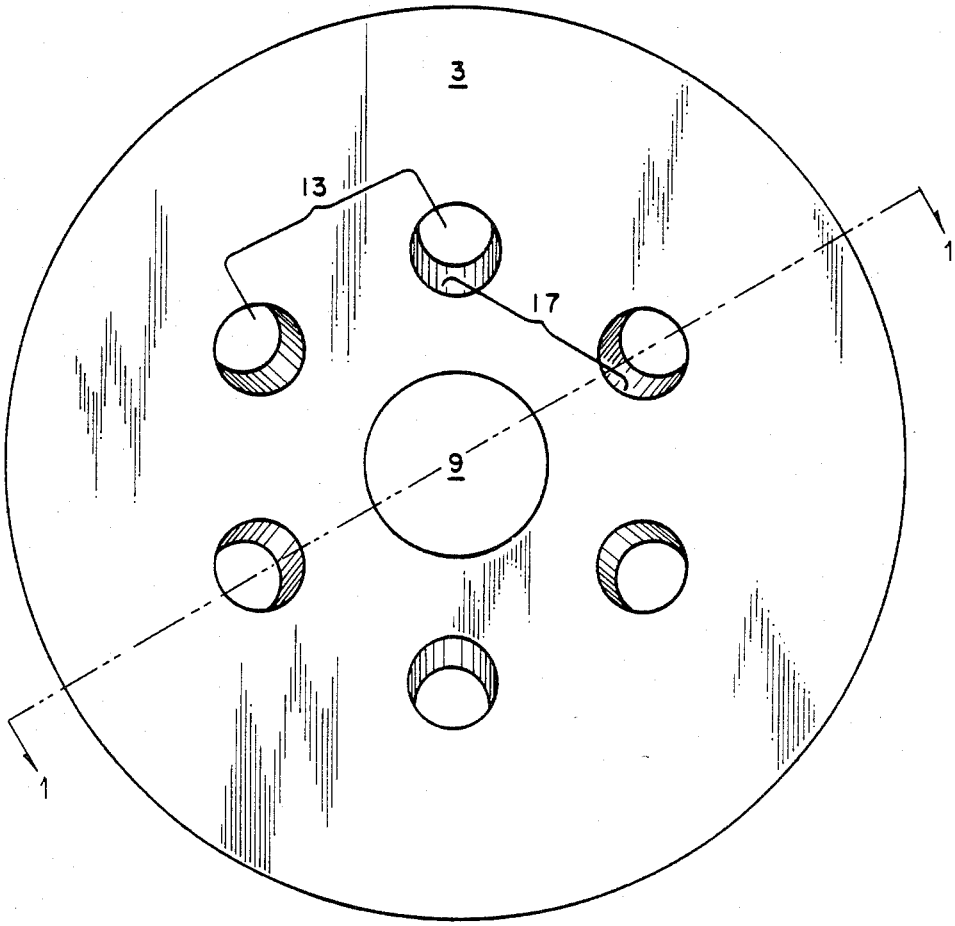
FIG. 2 shows front view II—II of FIG. 1.

The burner 1 is fitted in an opening (not shown) of a reactor wall, and comprises an outer wall 2 having a front part 3 forming the burner front and a composite inner wall structure 4/5. Between the outer wall 2 and the inner wall structure 4/5 is an annular space 6 for the passage of fluid, such as cooling water, to cool the front part of the burner. Cooling fluid passed via annular space 6 to the burner front part is withdrawn via an annular space 7 between inner wall 4 and a partition wall 8 in the inner wall structure 4/5. The inner wall 4 encompasses an axial passage 9 for the supply of finely divided solid fuel into a reactor space, indicated by reference numeral 10. The inner wall structure 4/5 is provided with a further partition wall 11 defining an annular passage 12 for oxygen, which passage substantially concentrically surrounds the axial fuel passage 9. Fluid communication between said oxygen passage 12 and reactor space 10 is obtained via a plurality of conduits 13, being substantially uniformly distributed around the axial fuel passage 9. As shown in FIG. 1, the outer parts of the conduits 13 are laterally inwardly inclined, in order to direct oxygen towards the fuel leaving axial passage 9. A suitable angle of inclination of the outer parts of conduits 13 with the axial passage 9 is chosen in the range of 20 to 70 degrees.

The burner front part shown in FIG. 1 further comprises an annular passage 14, for a moderator gas, substantially concentrically arranged with respect to the axial passage 9 and the annular oxygen passage 12. Said annular passage 14 is arranged between partition wall 11 and a further partition wall 15, positioned within the inner wall structure 4/5, and debouches into a plurality of moderator gas collecting spaces 16. Each collecting space 16 forms a fluid communication between the annular passage 14 and an annular conduit 17 arranged around the inclined outer part of a conduit 13.

In order to prevent heat transfer during operation of the burner between cooling fluid flowing through annular space 7 and the moderator gas, such as steam, passing through annular passage 14, an annular insulating space 18 is arranged between partition wall 8 and partition wall 15 in the inner wall structure 4/5.

During operation of the burner partly shown in the Figures, for the partial combustion of coal with oxygen, finely divided coal is passed with a carrier gas, through the axial passage 9 in order to supply a core of coal particles into the reaction space 10 downstream of the burner. The carrier gas which is used may be for example steam, carbon dioxide, nitrogen or cold reactor gas. The use of the last mentioned type of carrier gas offers the advantage that dilution of the formed reactor products is obviated, which dilution would occur when using an inert carrier gas.

For combustion of the coal, oxygen is supplied into the reactor space 10 via the annular passage 12 and the conduits 13. Due to the inward inclination of the outer parts of the conduits 13, the oxygen leaving said conduits is directed towards the core of solid fuel, thereby causing a breaking up of the coal flow and an intensive mixing of coal with oxygen. The velocity of the oxygen should be chosen such as to obtain a penetration of the oxygen in the coal flow without substantial re-emerging of the oxygen therefrom. Suitable oxygen velocities are chosen in the range of 20 through 90 m/s. The number of oxygen jets must be sufficient for allowing substantially the whole quantity of supplied coal to be contacted with oxygen, in order to minimize the formation of unreacted coal (char) in the reactor space 10. On the other hand, the conduits 13 should be sufficiently spaced apart from one another in order to prevent interference between adjacent oxygen jets. Interference of the oxygen jets would cause a decrease of the oxygen velocity and therefore a less effective breaking-up of the coal flow which in its turn would result in a less effective gasification of the coal within the time available in the reactor. The miniumum allowable angle of inclination of the oxygen jets with respect to the coal flow largely depends on the oxygen velocity. At a given oxygen velocity the minimum angle of inclination is determined by the impact of oxygen on the coal flow necessary for breaking-up the coal flow. In general, the minimum angle of inclination should not be chosen smaller than 20 degrees. The angle of inclination of the air jets should suitably not be chosen greater than 70 degrees, in order to prevent the formation of a coal-/oxygen flame too close to the burner front which might cause more damage to said burner front due to overheating. An even more suitable maximum angle of inclination is 60 degrees.

Prior to leaving the burner and entering into the reactor space 10 each oxygen jet is surrounded by an annulus of moderator gas, such as steam, supplied via annular passage 12, collecting spaces 16 and annular conduits 17. The moderator gas forms a shield around each oxygen jet thereby preventing a hot flame front near the burner due to premature contact of combustion oxygen with the hot product gases already formed in the reactor space 10. Apart from forming a shield around the oxygen jets, the moderator gas serves a further purpose in that it substantially fills up the spaces between adjacent oxygen jets upon contacting the core of coal, thereby suppressing the escape of coal from the central coal flow.

The velocity of the moderator gas is suitably chosen substantially equal to the velocity of the oxygen jets, in order to prevent additional turbulence in the oxygen/-moderator gas interface which might result in the outflow of oxygen through the shield of moderator gas. Apart from steam, any other suitable moderator gas, such as for example carbon dioxide can be used in the above described combustion process.

It should be noted that the present invention is not restricted to a burner of the above type having annular supply passages 12 and 14 for oxygen and moderator gas, respectively as shown in the drawings. Instead of the annular passage 12 in combination with the shown separate conduits 13, a plurality of oxygen supply conduits may be applied having their major parts running substantially parallel along the axial fuel passage 9 and having their outer parts inwardly inclined with respect to said passage 9. The annular supply passage 14 in combination with the collecting spaces 16 and annular conduits 17 may be likewise replaced by a plurality of annular passages, each surrounding an oxygen supply conduit. In view of the high velocity of the oxygen upon passing through the conduits 13, these conduits are preferably made from a material having a high resistance to friction-induced ignition. A suitable material for the oxygen conduits is for example inconel.

Further the burner front does not need to be flat as shown in FIG. 1, but may be slightly convex or slightly concave with respect to the axial fuel passage 9. The invention is not restricted to a burner having a cooling circuit as indicated in FIG. 1 with the reference numerals 6 and 7. Instead of, or in addition to a cooling circuit the burner walls may, for example, be provided with layers of heat insulating material.

What is claimed is:

1. A burner for the partial combustion of a finely divided solid fuel comprising:

a burner housing having a central passageway terminating in a central fuel outlet;

a plurality of oxygen outlets substantially equal spaced and surrounding said fuel outlet;

a plurality of annular outlets, one said annular outlet surrounding each of said oxygen outlets, said annular outlets being coaxial with said oxygen outlets and both said oxygen and annular outlets being inclined at an angle to the axis of the fuel outlet;

a first conduit means, said first conduit means being coupled to said oxygen outlets; and a second conduit means, said second conduit means being coupled to said annular outlets.

2. The burner as claimed in claim 1, wherein the angle of inclination with the central passage of the outlet passages is in the range of from 20 through 70 degrees.

3. The burner as claimed in claim 1, wherein the angle of inclination with the central passage of the outlet passages is in the range of from 20 through 60 degrees.

4. The burner as claimed in claims 1, 2 or 3, wherein the first conduit means and the central passage have substantially coinciding longitudinal axes.

5. The burner as claimed in claims 1, 2 or 3, wherein the second conduit means and the central passage have substantially coinciding longitudinal axes.

* * * * *